United States Patent [19]

Folgerö et al.

[11] 4,004,792

[45] Jan. 25, 1977

[54] METALLURGICAL FURNACE HAVING FLUID INJECTION MEANS FOR A MELT IN THE FURNACE

[75] Inventors: Kåre Folgerö, Vasteras; Lars-Gunnar Norberg, Hagfors, both of Sweden

[73] Assignee: Allmanna Svenska Elektriska Aktiebolaget, Vasteras, Sweden

[22] Filed: Oct. 23, 1975

[21] Appl. No.: 625,200

[30] Foreign Application Priority Data

Oct. 29, 1974 Sweden ..... 7413574

[52] U.S. Cl. ..... 266/218; 266/286

[51] Int. Cl.[2] ..... C21C 5/48

[58] Field of Search ..... 266/217, 218, 240, 245, 266/271, 281, 282, 283, 286

[56] References Cited

UNITED STATES PATENTS

| | | | |
|---|---|---|---|
| 2,641,461 | 6/1953 | Lewis | 266/218 |
| 3,918,692 | 11/1975 | Oberg | 266/218 |

*Primary Examiner*—Richard B. Lazarus
*Assistant Examiner*—John E. Roethel
*Attorney, Agent, or Firm*—Kenyon & Kenyon Reilly Carr & Chapin

[57] ABSTRACT

A metallurgical furnace vessel is provided with means for injecting fluid into a melt in a vessel, the fluid carrying materials reactive with the melt and incidentally causing rapid erosion of the vessel's wall portion above the location where the fluid is injected. This wall portion is provided with cooling means and is made so that it can be removed for repair or replacement.

3 Claims, 2 Drawing Figures

METALLURGICAL FURNACE HAVING FLUID INJECTION MEANS FOR A MELT IN THE FURNACE

BACKGROUND OF THE INVENTION

In the Fredrikson et al U.S. Pat. application Ser. No. 499,759, filed Aug. 22, 1974, having the same assignee as the instant application a metallurgical furnace is disclosed, the furnace basically comprising a vessel which tilts between substantially vertical and horizontal positions and having a refractory lining for containing a melt, such as a steel melt, to be finished as by being desulfurized, receiving alloying additions and the like or otherwise being treated. The vessel is vertically elongated and has the appearance of a Bessemer convertor, but the vessel is provided in its lower portion with a channel-type electric inductor so that the melt can receive heat during its treatment, thus permitting the addition of materials which not only do not exothermically result in heating the melt, but also which may result in having a cooling effect on the melt.

The inductor angles diagonally downwardly from one side of the vessel in a direction resulting in the inductor's channel always retaining sump metal when the vessel is tilted at its horizontal position, the opposite side which is uppermost when the vessel is horizontal, being provided with a nozzle for the injection of the fluid. The fluid can be an inert gas carrying particles of materials to be injected into the melt, the nozzle being positioned so that when the vessel is vertical, the nozzle is below the melt level.

In the operation of this furnace in its vertical position, when the fluid is being injected into the melt, the nozzle is subjected to rapid wear. With this in mind, the Folgero et al U.S. Pat. application Ser. No. 560,204, filed Mar. 20, 1975, having the same assignee as the instant application discloses a nozzle for the vessel of the Fredrikson et al application, which is made so that it is easily removable. In addition, this nozzle, having the necessary fluid-injection passage, has a mass of metal, such as copper, surrounding the passage at a position spaced outwardly from the melt, this mass being provided with cooling means and functioning to cool and freeze any inadvertent outward flow of the melt, such as might result from failure of fluid blast injection equipment, thus plugging the passage and preventing a melt break-out backwardly or outwardly through the nozzle's passage.

In addition to the nozzle wear or erosion, the furnace of the Fredrikson et al patent application presents an additional operational problem in that the portion of the necessary lining of the furnace vessel, immediately above the nozzle, is subjected to substantially greater wear and erosion than is the balance of the lining. Unless this problem is solved, it is necessary to put the furnace out of operation to repair that localized portion of the lining, even though the balance of the lining is potentially capable of a much longer service life.

SUMMARY OF THE INVENTION

The present invention is for the purpose of solving the above problem. Briefly stated, the furnace of the Fredrikson et al patent application involves a vessel having a lower portion with substantially opposite sides through which first and second openings are formed respectively, the first opening giving the melt access to the electric inductor means which, being preferably a channel-type inductor, receives and heats a portion of the metal, the fluid-injection nozzle being positioned in the second opening. In the present case, the vessel has a removable refractory wall portion extending upwardly from this second or nozzle opening and, of course, the nozzle itself, this wall portion, the second opening and the nozzle being free from the melt when the vessel is tilted to its horizontal position. When the injection treatment of the melt in the vessel is completed, the vessel is tilted to this horizontal position, a tap hole in what is then the lower side of the furnace, being opened for tapping the melt.

It follows that when the furnace is horizontal, the nozzle can be removed from the second opening, which is then uppermost, in accordance with the Folgero et al patent application teaching. In the present case, if the furnace lining portion above the nozzle is found to be worn or eroded excessively, this lining portion also can be removed for servicing or replacement. Therefore, the furnace need not be put out of service for a prolonged time period, until the balance of its lining requires servicing.

As an additional advantage, the present invention provides for mounting both the nozzle and the furnace lining portion above the nozzle, by a metal plate removably fixed to the usual metal shell that surrounds and supports the refractory lining of metallurgical furnaces in general. The furnace shell must have an opening for both the nozzle and the removable wall portion above the nozzle, and the metal plate mounting these parts completely covers this opening and completes the integrity of the outside of the vessel.

BRIEF DESCRIPTION OF THE DRAWINGS

In the accompanying drawings, one example of this new furnace is illustrated.

DETAILED DESCRIPTION OF THE INVENTION

Figure 1:
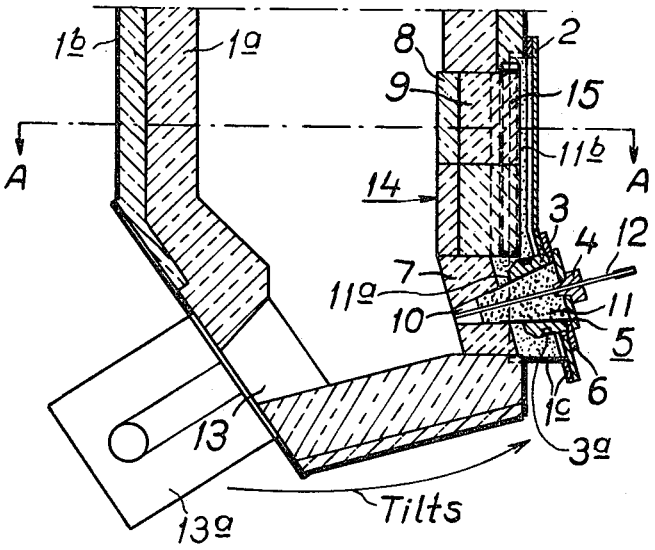
FIG. 1 showing only the lower portion of the furnace, in vertical section, but being adequate to show all details required to explain the present invention, FIG. 2 being a cross section taken on the line A—A in FIG. 1.
Figure 2:
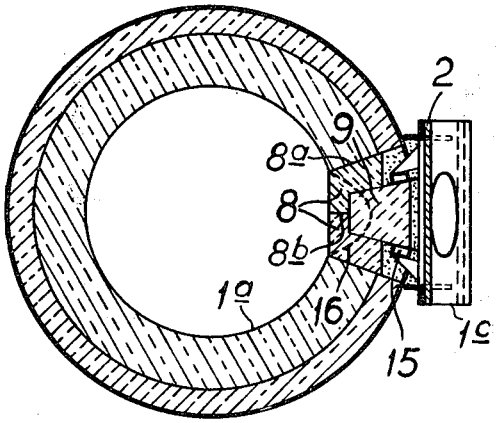

In the above drawings, the numeral 5 shows a nozzle such as is disclosed by the previously mentioned Folgero et al patent application. This comprises a conical blast stone 7 inserted in the opening formed in the furnace lining 1*a*, an inner conical blast stone 10 being positioned in a conical hole formed in the blast stone 7. Refractory compound 11 is rammed into a conical metal shell 11*a* around a metal blast pipe 12, this shell being seated within a massive and highly conductive metal annulus 3 having water-cooling passages 3*a*. On the outside the massive copper freezing plug 4 surrounds the pipe 12, as previously indicated. The water-cooling separated via the passage 3*a* prevents the rammed material 11 from sintering into a solid mass.

This nozzle assembly 5 is removably fixed to a mounting plate 6.

The removable wall portion 14 immediately above the nozzle assembly, comprises, relative to the inside of the furnace, an inner conical body 8 removably seated in a correspondingly shaped opening 8*a* formed in the furnace lining 1*a*, this part being formed by segments which are separable as indicated by the lines 8*b*. An outer conical refractory body 9 having water-cooling passages 15 is seated within this inner portion 8. Although the term conical has been used, the parts 8 and 9 which interfit, need only be inwardly tapered. The necessity is that these refractory parts be restrained from moving inwardly.

The inner and outer removable furnace lining parts 8 and 9 are prevented from outward movement by a metal plate 2 which is peripherally fixed to the metal shell 1*b* of the furnace vessel. This plate 2 extends downwardly to form a box construction 1*c* to which the mounting plates of the removable nozzle are removably fixed. Refractory material 11*b* is rammed into the space between the plate 2, the parts 11*a* and 3 of the removable nozzle and the outsides of the removable refractory parts, thus holding the latter against outward displacement, the conical or inwardly tapered shapes of these refractory parts preventing inward movement.

The rammed material, such as shown at 11 and 11*b*, may be any of the commerically available refractory materials which can be injection molded into the spaces requiring filling. The heat of the melt can be used to sinter such materials into solid masses. However, the parting surfaces required for removal of the nozzle and the furnace wall portion 14 should be treated to prevent them from intersintering and becoming bonded together. A joint compound of the type disclosed in U.S. Pat. No. 3,249,676 may be used to prevent bonding of parts which must be separated to remove the nozzle and removable wall portion from the furnace.

In FIG. 1 on the other side of the furnace from the nozzle, the opening 13 is shown to which the channel inductor 13*a* is ordinarily applied. Being opposite to the wall portion 14, the pinch effect exerted by this inductor tends to circulate the melt very closely against the wall portion 14, while reactive materials injected through the nozzle directly below this portion, add to the erosion of the area 14. With this removable wall portion 14 water-cooled as indicated, its life is prolonged but eventually this removable portion 14 becomes worn to a greater degree than the balance of the furnace lining.

The nozzle 5 can be removed individually by separating its mounting plates from the outside of the protective plate 2 of the entire assembly. This permits the nozzle alone to be withdrawn for servicing or replacement. To inspect, repair or replace the removable lining portion 14, the protective plate 2 is separated from the outer shell 1*b* of the furnace, permitting both the removable wall portion and the nozzle to be removed simultaneously, this, of course, being done while the furnace is horizontal with any melt the vessel contains, being free from what is the upper side of the furnace when the vessel is horizontal.

In the practical execution of the present invention, normal metallurgical furnace engineering is applicable. The vessel lining 1*a* and its metal shell 1*b* may follow conventional design. For the nozzle and removable wall portion areas, the metal shell 1*b* must provide an opening. Inside, the furnace lining 1*a* should be formed to provide the tapered sides 8*a* for the parts 7 and 8, this inner part 8 being formed from segments which together with the use of a suitable parting compound, permits separation of the parts. The outer wall portion part 9 is itself individually removable from the inner part 8 and mates with the latter by way of tapered surfaces, the water-cooling of this part 9 further serving to assure ultimate separability while by conduction of heat from the inner part 8, extending the life of the latter. Although the material rammed between the outer sides of the parts 8, 9 and 7, and the plate 2 and around the conical steel shell 11*a* as well as in its interior, may sinter from the melt heat, it should remain in a frangible condition so that after removal of the protective plate 2, it can be chipped away to obtain the desired separability. There are commercially available injection-molding materials based on $Al_2O_3$ or MgO, which are suitable. The ram material needs only to carry compression between the plate 2 and the parts inside of this plate which must be prevented from being displaced outwardly.

As previously indicated, the furnace is a tilting furnace, the arrow marked "tilts" indicating the tilting direction. When horizontal, the nozzle and the removable wall portion are free from the melt. Normally, removal of the parts would occur after tapping of the heat and when only the channel of the channel-type inductor 13*a* retains sump metal.

What is claimed is:

1. A metallurgical furnace comprising a vessel which tilts between substantially vertical and horizontal positions and having a refractory lining for containing a melt, said vessel having a lower portion with substantially opposite sides through which first and second openings are formed respectively, the first opening giving the melt access to an electric inductor means for receiving and heating a portion of the melt and a fluid-injection nozzle being positioned in the second opening, said vessel having a removable refractory wall portion extending upwardly from said second opening and nozzle, said wall portion, second opening and nozzle being free from the melt when said vessel is tilted to a substantially horizontal position, said second opening being formed by inwardly tapered boundary surfaces of said lining, and said removable refractory wall portion having correspondingly tapered boundary side surfaces and being formed as separable inner and outer parts with respect to the inside of said vessel, said inner part being formed by separable segments.

2. The furnace of claim 1 in which said wall portion has means for removing heat therefrom by water cooling.

3. The furnace of claim 1 in which said vessel and said removable refractory wall portion have outsides, a protective plate being positioned over the outside of said wall portion.

* * * * *